United States Patent [19]

Bock et al.

[11] Patent Number: 4,938,133

[45] Date of Patent: Jul. 3, 1990

[54] PRINTING MACHINE HAVING CHAMBERED DOCTOR BLADE UNIT INKER

[75] Inventors: Georg Bock, Augsburg; Franz X. Gollinger, Hirschbach; Thomas John, Augsburg, all of Fed. Rep. of Germany

[73] Assignee: MAN Roland Druckmaschinen AG, Augsburg, Fed. Rep. of Germany

[21] Appl. No.: 403,760

[22] Filed: Sep. 6, 1989

[30] Foreign Application Priority Data

Sep. 22, 1988 [DE] Fed. Rep. of Germany ..... 3832160

[51] Int. Cl.[5] ..... B41F 31/00; B41F 9/16

[52] U.S. Cl. ..... 101/349; 101/157; 101/348

[58] Field of Search ..... 101/348, 349, 350, 157

[56] References Cited

U.S. PATENT DOCUMENTS

| | | | |
|---|---|---|---|
| 2,691,344 | 10/1954 | McMullen | 101/157 |
| 2,695,004 | 11/1954 | Montgomery et al. | 101/350 |
| 3,566,787 | 3/1971 | Moos | 101/350 |
| 4,515,078 | 5/1985 | Difflipp et al. | 101/157 |
| 4,590,855 | 5/1986 | Schommer et al. | 101/350 |
| 4,700,631 | 10/1987 | Jurinak | 101/350 |

FOREIGN PATENT DOCUMENTS 8216721 9/1982 Fed. Rep. of Germany .

*Primary Examiner*—Edger S. Burr
*Assistant Examiner*—John S. Hilten
*Attorney, Agent, or Firm*—Frishauf, Holtz, Goodman & Woodward

[57] ABSTRACT

To permit easy removal and/or engagement and disengagement of a chambered doctor blade unit (1) from an anilox roller (2), the chambered doctor blade unit is attached to a holder (4) which has axially extending projecting pins or bolts (6, 7). The pins or bolts (6, 7) engage in hook-like extensions (12, 13) depending from a cross member (9) extending between the side walls (8) of the printing machine. An eccentric clamping cam disk (10) is rotatable about the cross member (9) and bears, in dependence on the rotary position thereof, against an upper surface of the holder for the chambered doctor blade unit (1) to thereby ensure interengagement of the projecting pins or bolts (6, 7) in the hook-like extensions (12, 13) and on support as well as locating surfaces (14, 16; 17, 18) thereof, while permitting quick release of this interengagement permitting movement and easy removal of the chambered doctor blade unit (1).

20 Claims, 5 Drawing Sheets

PRINTING MACHINE HAVING CHAMBERED DOCTOR BLADE UNIT INKER

Reference to related applications, assigned to the assignee of the present application, the disclosures of which are hereby incorporated by reference:

U.S. Ser. No. 07/403,754, filed Sept. 6, 1989, JOHN

U.S. Ser. No. 07/403,620, filed Sept. 6, 1989, BOCK et al

Reference to related literature

"Technik des Flexodrucks" ("Technology of Flexography"), Coating Verlag Thomas & Co., publishers.

FIELD OF THE INVENTION

The present invention relates to inkers for printing machines, and especially for offset or flexo-printing machines, and more particularly to a construction of a chambered doctor blade unit which permits ready exchange of the chambered doctor blade unit for another one.

BACKGROUND

The referenced book "Technik des Flexodruckes" ("Technology of Flexoprinting"), Coating Verlag Thomas & Co., publishers, describes doctor blade units in which the doctor blades are coupled to a structural element which defines a chamber, to which ink is being supplied. This chamber forms an ink retention chamber, retaining and applying the ink to the anilox roller of the inker. For simplicity of description, this type of combination of doctor blades and ink supplying chamber will be referred to as a chambered doctor blade unit. Chambered doctor blade units as described in the literature reference are constructed as structural elements which are connected by screw connections to a cross member on the printing machine. If it is desired to exchange or disassemble the chambered doctor blade unit, for example to change color of the ink, a substantial number of screw connections must be loosened and, after exchange of the unit, must again be reconnected.

In many printing machines, a plurality of such chambered doctor blade units are located axially adjacent each other; to disassemble and reassemble such units is time-consuming and requires skilled adjustment for proper placement of the doctor blades of the units with respect to the anilox roller. Chambered doctor blade units are also at times referred to as doctor blade ink chambers.

THE INVENTION

It is an object to provide a chambered doctor blade unit which can be easily assembled on a printing machine or disassembled therefrom, and which is so constructed that exchange of the unit for another one can be done quickly, while placing the unit in properly adjusted position with respect to the anilox roller.

Briefly, a cross member extends axially parallel to the anilox roller. The chambered doctor blade units have carrier elements thereon, the cross member has holder elements on it, and releasable coupling means are provided to interconnect the carrier and the holder elements. To effect such interconnection, one of the elements is formed with hook-like extensions and the other of the elements has axially extending pins or bolts or stubs engageable in the hook-like extensions. The hook-like extensions are formed with a support surface and that one of the hook-like extensions which is closest to the anilox roller is further formed with radially spaced positioning surfaces to receive the pins and properly locate the chambered doctor blade unit in position. A clamping arrangement is located on the cross member adjacent each of the holder elements of the chambered doctor blade units to interengage the axially extending pin or bolt and the hook-like extensions and place the pins or bolts against the positioning surfaces, while permitting ready release of the chambered doctor blade unit and pivoting into an inoperative position about an axis formed by that one of the axially extending pins or bolts which is located against the positioning surface.

DRAWINGS

FIG. 4 is a fragmentary view showing placement of an axially extending projection;

DETAILED DESCRIPTION

Figure 1:
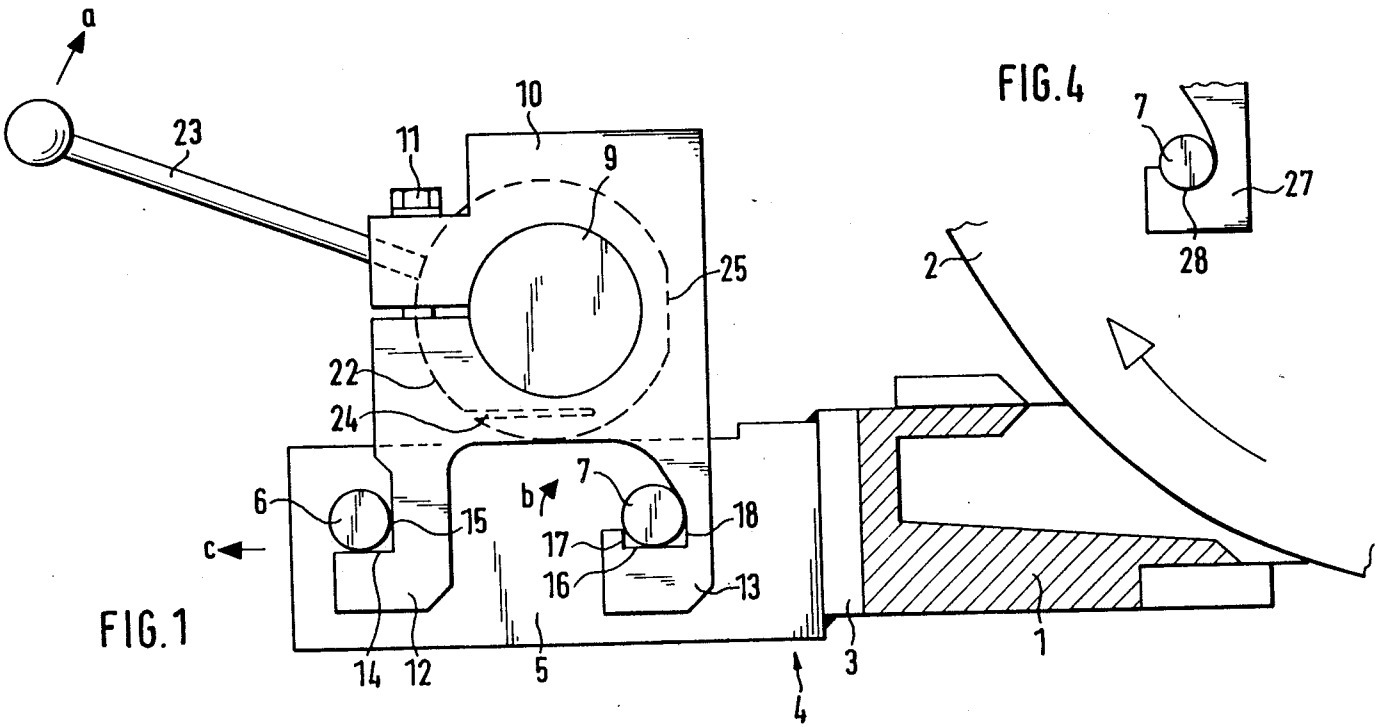
FIG. 1 is a schematic side view of an inker in accordance with the present invention.
Figure 5:
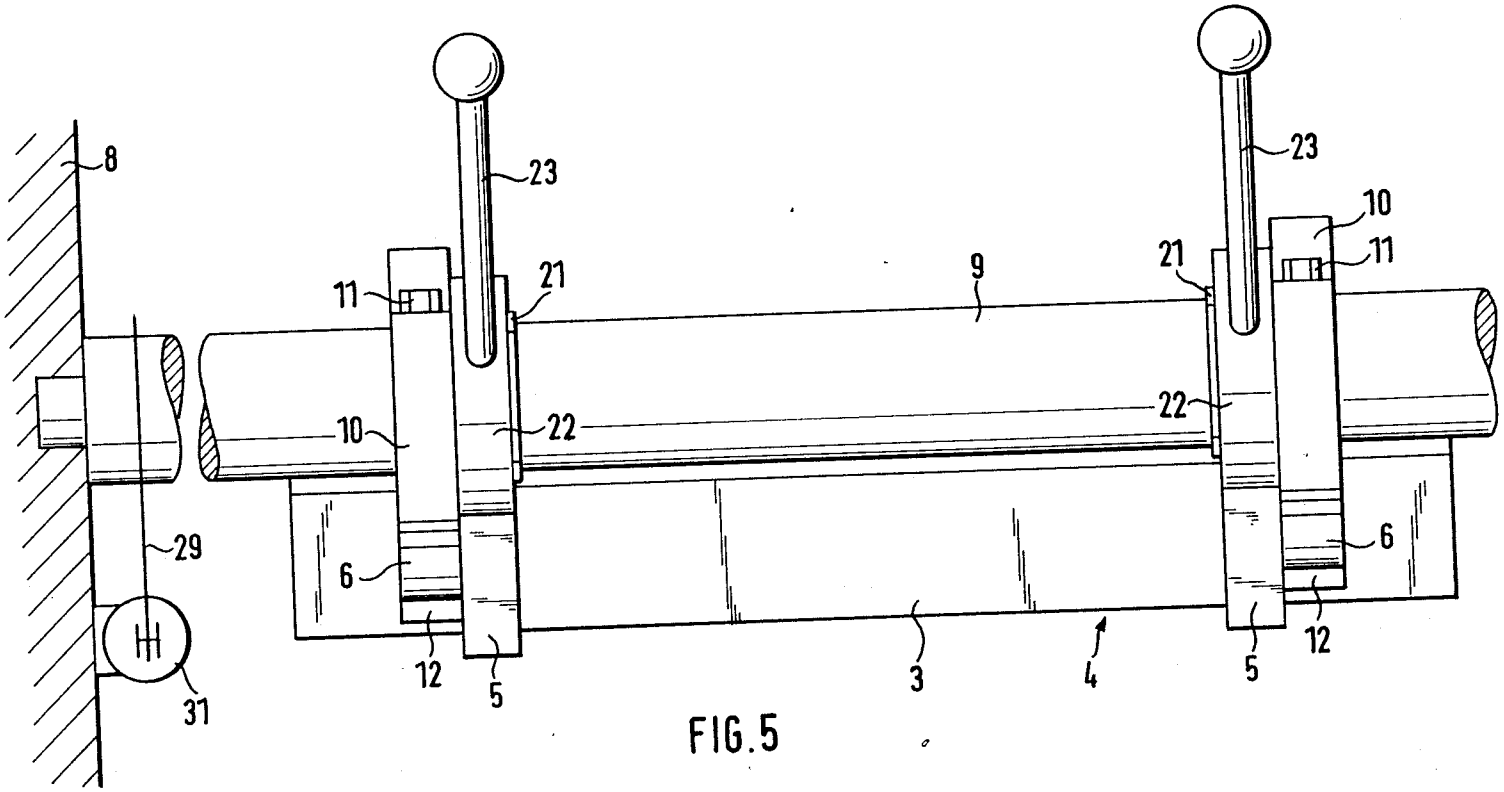
FIG. 5 is a front view of the inker of FIG. 1.

Referring first to the embodiment shown in FIGS. 1 and 5: A chambered doctor blade unit 1 (FIG. 1) is located on a printing machine having a cross element 9, positioned between two printing machine side walls 8 (FIG. 5). The chambered doctor blade unit 1 applies ink to an anilox roller 2. The unit 1 is coupled by an end plate 3 to a carrier generally shown at 4. The carrier 4 has two clamping plates 5. Each one of the clamping plates 5 has two axially extending bolts or pins or stubs 6, 7 attached thereto. The longitudinal axes of the bolts, pins or stubs 6, 7 extend parallel to the longitudinal axis of the anilox roller 2.

The system is particularly suitable to mount and dismount, or assemble and disassemble a plurality of chambered doctor blade units 1 axially adjacent each other on the cross member 9.

To attach any one of the chambered doctor blade units 1, the cross member 9 has two holders 10 thereof associated, respectively, with a specific one of the chambered doctor blade units. The holder elements 10 have a slit extending radially from one side thereof towards the cross member 9 which, preferably, is circular. The holder elements 10 are secured on the cross member 9 so as to be fixed with respect thereto, so that they cannot rotate with respect to the member 9 or slide axially. Clamping screws 11 clamp the holder elements 10 on the cross member 9.

Each one of the holder elements 10 has two hook-like projections 12, 13, depending therefrom. The hook-like projection 12, remote from the doctor blades of the chambered doctor blade unit 1, has a lower support surface 14 and an abutment surface 15 for the cylindrical bolt, pin or stub 6. When the chambered doctor blade unit is in operative condition or position, the bolt is supported on surface 14 but does not engage the abutment surface 15.

The hook-like extension 13, closest to the anilox roller 2 and to the chambered doctor blade unit 1, has a support surface 16 and two engagement surfaces 17, 18, located opposite each other and spaced from each other, for engagement with the bolt, pin or stub 7. The engagement surface 17 is so short that the cylindrical bolt 7 can be released from the hook-like projection 13 by lifting it off.

Figure 2:
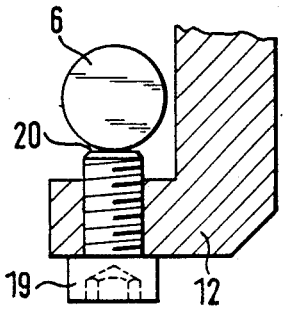
FIG. 2 is a fragmentary view showing one form of an adjustment arrangement.

The engagement surface 14 of the hook-like projections 12 need not be formed on the projection itself; as seen in FIG. 2, it can be formed by the end surface of an adjustment screw 19. This permits individual fine adjustment of the position of the doctor blades of the doctor blade unit 1 with respect to the anilox roller 2.

Figure 3:
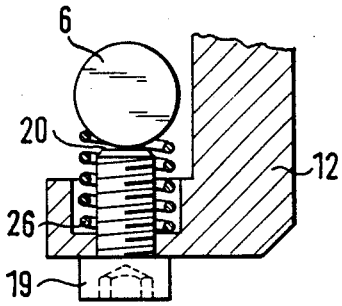
FIG. 3 is a fragmentary view of the inker showing another form of the adjustment arrangement.

FIG. 3 illustrates another embodiment, in which the projection 12 is formed with a cylindrical recess in the upper surface thereof and partly surrounding the bolt 19. A spring 26 is located in that recess, engageable with the pin 6, so that, upon placement of the chambered doctor blade unit 1, coupled to the carrier 4, the cylindrical pin, bolt or stub 6 will first be supported by the spring and then be engaged against the surface 20 upon subsequent clamping, as will appear below.

The hook-like projection 13 need not be formed as shown in FIG. 1 but, rather, can be formed with an essentially circular surface 28, provided in the lower portion 27 of the hook-like projection 13, so that the cylindrical bolt, pin or stub 7 will fit therein as best seen in FIG. 4.

A safety holder ring 21, for example a C-ring, is located on the cross element 9, to retain in position a clamping element 22 in form of a clamping cam against the holder 10. A manually operable lever 23 is secured to the clamping element 22. The camming inclination of the clamping cam is so selected that it will be self-locking or self-holding with respect to the clamping plate 5. A slit 24 can be provided in the clamping cam 22 so that the force applied by the clamping cam 22 on the clamping plate 5 can be provided, in part, by elastic deformation of the clamping element 22.

Operation and Assembly

FIG. 1 illustrates the arrangement in operated position, in which the doctor blades of the chambered doctor blade unit 1 are in engagement with the anilox roller 2. If it is desired to remove and interchange the chambered doctor blade unit 1, hand levers 23 are moved in the direction of the arrow a of FIG. 1. This releases the clamping force which acts on the clamping plates 5. The carrier element 4, together with the doctor blade unit 1, can be slightly tilted about the axes of the bolt 7 in the direction of the arrow b (FIG. 1) until the bolts 6 engage the engagement surface 15, since the center of gravity of the chambered doctor blade unit 1, coupled to the carrier 4, will be between the bolt 7 and the anilox roller 2. This slightly releases the doctor blades of the doctor blade unit 1 from the anilox roller 2. This position is suitable for short operating interruptions. Preferably, the clamping elements 22 have a plurality of flattened surfaces or lands 25, defining respective positions, namely a short-time release position, described above, and an interchange position, to permit removal of the chambered doctor blade unit 1 together with the holder 4. The slight tilting of the unit 1 is additionally assisted by the springs 26 (FIG. 3) if this embodiment is utilized, and which is effective between the bolts, pins or stubs 6 and the projection 12.

In that position, or a further "release" position of the lever 23, it is also possible to remove the chambered doctor blade unit 1 and exchange it for another one. To remove the unit 1 together with the carrier 4, it is so moved that the bolts 7 can be lifted off the engagement surface 17 (FIG. 1) and then the parts 1 and 4 are moved in the direction of the arrow c so that the bolts 6 and 7 are completely released from the holding projections 12 and 13.

Assembly and positioning of a new or different doctor blade unit 1, for example to be associated with a different colored ink, is done in reverse manner to that just described. First, the bolts 7 are introduced, at an inclination from above, between the engagement surfaces 17, 18 until they are supported on the support surface 16. Thereafter, lever 23 is moved in a direction counter that of the arrow a (FIG. 1). This presses the clamping elements 22 downwardly, and hence moves the bolts 6 and 7 via the clamping plate 5 against the support surfaces 14 and 16 and lock the chambered doctor blade unit 1 in operative position.

Exchange of the chambered doctor blade unit 1 can, thus, be carried out simply without loosening of screw connections, merely by operating the lever 23, releasing the clamping connection, and unhooking the bolts 6, 7 from their hooked position.

Removal of the unit can be facilitated by utilizing the lower holding portion 27 (FIG. 4) with the hooked surface 28 matching the circumference of the cylindrical bolt 7. The support surface 16 and the engagement surfaces 17, 18 form, together, a single surface 18 which is in generally half-shell configuration, similar to a half-bearing. The radius of the surface 28 should correspond roughly to the radius of the bolt 7, or be slightly larger.

A plurality of chambered doctor blade units 1 can be located axially adjacent each other. Each chambered unit 1 will have two holders 10 with clamping elements 22 associated therewith. It is also possible to provide an arrangement in which a single unit 1 is used, extending over the entire width of the anilox roller 2. If only one unit 1 is used, it requires only two holders 10; if additional holders are present, they are out of operation. If the chambered unit is narrow, for example to print only on a margin or in a very narrow stripe, a single holder element 10, supporting a single carrier element 4, and located centrally with respect to the axial extent of the chambered unit 1 may be sufficient. A plurality of such narrow chambered doctor blade units 1 can then be placed axially adjacent each other on the support rod or element 9.

Figure 6:
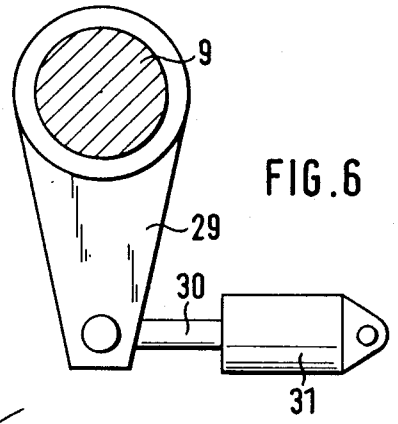
FIG. 6 is a fragmentary side view illustrating a moving arrangement for the inker of FIG. 5.

Under some operating conditions it may be occur that the chambered doctor blade unit 1 should be removed from the anilox roller 2 because of an extended interruption in printing operation. To permit such removal, the cross rod 9 is rotatably located between the side walls 8 of the printing machine. Upon rotation of the cross rod 9, see FIG. 6, by an operating lever 29 coupled to the rod 9, chambered doctor blade unit 1, or the plurality of units 1, can be pivoted away from the anilox roller 2. The lever 29 is coupled to a link 30 which, in turn, is coupled to a positioning element 31. The positioning element 31 can be fluid-operated, that is, may be a hydraulic or pneumatic cylinder-piston combination, it may be a solenoid, or an electric motor unit. For most installations it is desirable to have such an additional rotation element for the shaft 9 since a prior rotation of the shaft 9 will also facilitate exchange of one or more of the chambered doctor blade units 1, as previously described.

Figure 7:
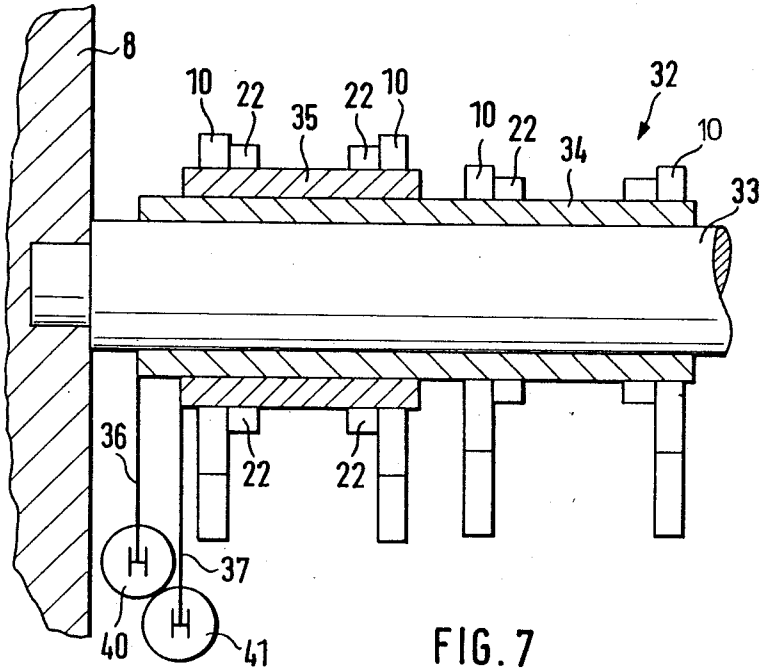
FIG. 7 is a schematic, partly sectional front view of another embodiment of the invention.
Figure 8:
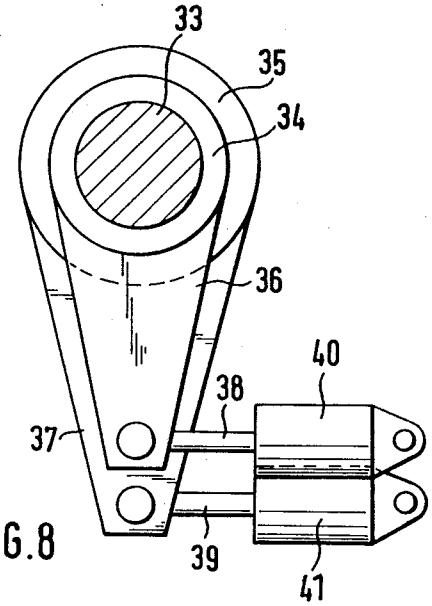
FIG. 8 is a side view of the arrangement in accordance with FIG. 7.

Many installations may have a plurality of chambered doctor blade units attached thereto; it is then desirable to selectively place out-of-operation only one or a selected group of chambered doctor blade units. Referring to FIGS. 7 and 8: The cross element 9 is replaced by a shaft 33, secured to the side walls 8 and forming a cross carrier or cross rod. A plurality of hollow shafts 34, 35 surround the cross rod 33. The hollow shafts 34, 35 are rotatable with respect to the rod 33, and rotatable relative to each other. Each one of the hollow shafts 34, 35 is securely connected to a positioning lever 36, 37, respectively (see FIG. 8), each of which is individually coupled to a positioning rod 38, 39 which, in turn, is operated by a suitable positioning element 40, 41, respectively. Each of the hollow shafts 34, 35 is coupled to one or two holders 10, in dependence on the width and construction of the respective chambered doctor blade unit 1. The doctor blade units 1 as well as the holders 10 are shown only schematically in FIG. 7, and each have a respective clamping element 22 associated therewith. Thus, the positioning cylinders 41, upon operation, can then disconnect only that one of the chambered doctor blade units 1 which is secured to the holders 10 and to the hollow shaft 35.

Figure 9:
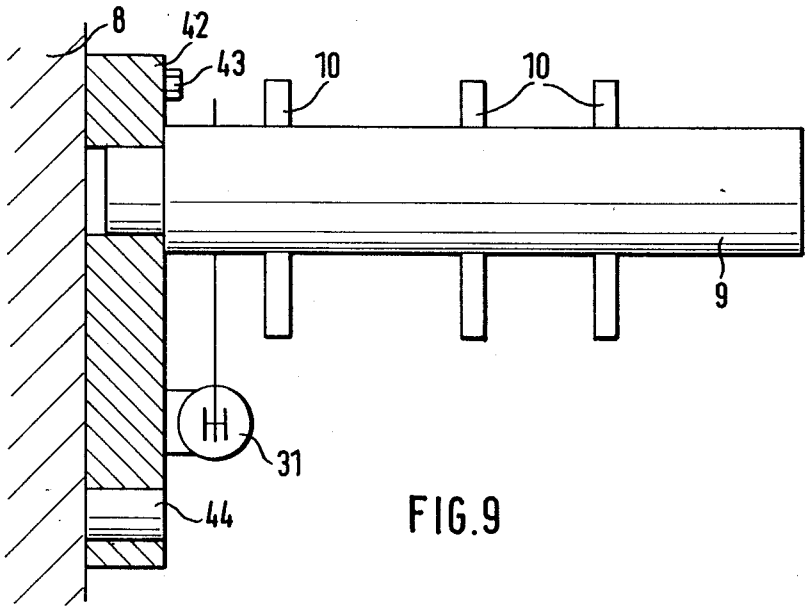
FIG. 9 is a schematic front view of a third embodiment of the invention.
Figure 10:
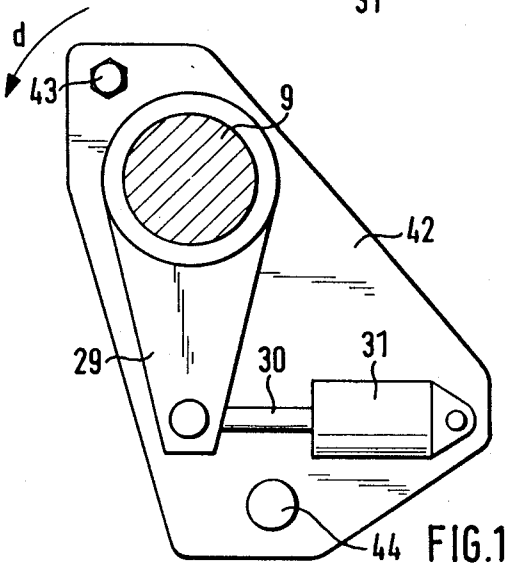
FIG. 10 is a side view of the arrangement of FIG. 9.

The anilox roller 2 may, from time to time, require cleaning, replacement, and the like, and, therefore, must be so positioned in the printing machine that it can be removed. To facilitate removal of the anilox roller 2, or to provide easy access thereto throughout its circumference, it is desirable to permit displacement of the entire inker as a unit from the anilox roller 2. As best seen in FIGS. 9 and 10, the cross element 9, or 33, for example, together with the associated positioning element 31 or 40, 41, respectively, is secured to a side plate 42 which is so attached to the side wall 8 that, upon loosening of the appropriate attachment screws 43, the entire cross element 9, together with any of the associated positioning elements 31; 40, 41, and all associated apparatus including the chambered doctor blade units 1, can be rotated out of position and engagement against the anilox roller 2. Preferably, the plate 42 is secured to the side wall 8 by a positioning pin 44, about which the plate 42 and all apparatus and devices connected thereto can be pivoted upon removal of a single bolt 43, as seen in FIG. 10.

Various changes and modifications may be made and any features described herein may be used with any of the others, within the scope of the inventive concept.

We claim:

1. A printing machine having a chambered doctor blade unit inker comprising a cross member (9) extending axially parallel to an ink receiving roller (2);

at least one chambered doctor blade unit (1) adjacent said ink receiving roller (2);

at least one carrier element (4) secured to said at least one chambered doctor blade unit;

at least one holder element (10) secured to said cross member (9) for retaining said chambered doctor blade unit;

coupling means for releasably coupling said at least one holder element (10) and said at least one carrier element (4) including an axially extending projecting means (6, 7) formed on one (4) of said elements and hook-like extending means (12, 13) formed on the other (10) of said elements to receive said projecting means (6, 7), said axially extending projecting means (6, 7) and said hook-like extending means (12, 13) being located on at least one line extending substantially radially, with respect to said ink receiving roller, wherein the hook-like extending means (12, 13) define a support surface (14, 16; 28) and the hook-like extending means (12, 13), in a region closest to the ink receiving roller (2), is formed with two radially spaced positioning surfaces (17, 18; 28), for receiving, supporting and positioning said axially extending projecting means (6, 7);

and a clamping means (22) actuatable in first and second directions located on the cross member (9) adjacent the holder element (10), said axially extending projecting means (6, 7) and the hook-like extending means (12, 13), upon actuation of said clamping means in the first direction, engaging the axially extending projecting means (6, 7) against said support surfaces (14, 16; 28) when the chambered doctor blade unit (10) is in operative position upon actuation of said clamping means in the second direction, while release of said chambered doctor blade unit (1) from said operative position and pivoting of said unit to an inoperative position is permitted.

2. The printing machine of claim 1, wherein said axially extending projecting means (6, 7) form projecting pins, bolts, or stubs and are located on the carrier element (4); and the hook-like extending means (12, 13) comprise depending extensions having hook-like terminating ends extending downwardly from said holder element (10).

3. The printing machine of claim 1, wherein each chambered doctor blade unit (1) has two carrier elements (4) secured thereto, one each located at an axial end of said chambered doctor blade unit;

and two holder elements (10) are secured to said cross member (9) for engagement with respective ones of said carrier elements (4).

4. The printing machine of claim 1, wherein a plurality of chambered doctor blade units (1) are located on said cross member (9) positioned axially, with respect to said ink receiving roller, adjacent each other.

5. The printing machine of claim 1, wherein said clamping means (22) comprises a rotatable clamping cam (22) acting on a surface of said carrier element (4).

6. The printing machine of claim 5, further including manually operable means (23) engageable with said clamping cam (22).

7. The printing machine of claim 5, wherein said clamping cam (22) is a plate-like element surrounding said cross member (9) and formed with a slit extending from an outer edge surface inwardly thereof to provide for resilient clamping upon rotation of said cam.

8. The printing machine of claim 1, wherein said support surface (14, 16) of at least one of the hook-like extending means (12, 13) comprises a surface element (19) having a surface region (20) which is adjustable with respect to engagement by the respective carrier element.

9. The printing machine of claim 1, further including spring means (26) positioned to project from at least one of the support surfaces (14, 16) of at least one of the hook-like extending means (12, 13) to provide for compression of the spring counter the spring force upon operation of said clamping means and seating of the carrier element (4) on the respective support surface.

10. The printing machine of claim 1, wherein two hook-like extending means are provided; and wherein that one (13) of the hook-like extending means closest to the ink receiving roller (2) is formed with a rounded hook surface (28) merging said radially spaced positioning surfaces and said support surface (16) into one smooth essentially part-semi-circular contour;

and wherein the respective axially extending projecting means (7) fitting into said hook-like extension comprises a cylindrical element rotatable on the surface defined by said essentially semi-cylindrical contour.

11. The printing machine of claim 1, wherein two hook-like extending means are provided; and wherein the hook-like extending means (12) which is most remote from the ink receiving roller (2) is formed with an abutment surface (15) defining a limiting position for the associated axially extending projecting means (6), said axially extending projecting means (6) being spaced from said abutment surface (15) when the chambered doctor blade unit (1) is located in said operative position.

12. The printing machine of claim 1, wherein said printing machine has side walls (8);

and wherein said cross member (9, 32) is rotatably positioned between said side walls.

13. The printing machine of claim 12, further comprising power positioning means (31, 40, 41) engageable on said cross member (9, 32) for rotating said cross member and, selectively, at least one chambered doctor blade unit (1) thereon.

14. The printing machine of claim 12, wherein said cross member (32) comprises a support shaft (33) and a plurality of hollow shaft elements (34, 35);

and wherein at least one holder element (10) is located on a respective hollow shaft element;

and operating means (40, 41) are provided, coupled to respective hollow shaft elements for rotating the associated hollow shaft element.

15. The printing machine of claim 1, wherein said printing machine has side walls (8);

further including attachment plates (42) located on said side walls, and pivotably coupled thereto, said cross member (9) being secured to the attachment plates at axial ends thereof;

and releasable fastening means (43) securing the attachment plates to the side walls (8) of the printing machine while permitting, upon release of said fastening means, rotation of the cross member together with said attachment plates.

16. The printing machine of claim 2, wherein the ink receiving roller is an anilox roller.

17. The printing machine of claim 16, wherein each chambered doctor blade unit (1) has two carrier elements (4) secured thereto, one each located at an axial end of said chambered doctor blade unit;

and two holder elements (10) are secured to said cross member (9) for engagement with respective ones of said carrier elements (4).

18. The printing machine of claim 17, wherein said clamping means (22) comprises a rotatable clamping cam acting on a surface of said carrier element (4).

19. The printing machine of claim 1, wherein said clamping means comprises a disk-like eccenter rotatable about said cross member (9) and having an external surface eccentric with respect to said cross member, said external surface being engageable against an upper surface of the carrier element (4), and being formed with at least one land or rest surface (25) defining a predetermined release position of said eccentric clamping means (22).

20. The printing machine of claim 1, wherein said axially extending projecting means (6, 7) comprises two essentially parallel spaced projecting pins, bolts or stubs located on said carrier element and projecting therefrom;

and wherein the hook-like extending means (12, 13) comprises depending extensions having two hook-like terminating ends extending downwardly from said holder element (10) and engageable with respective ones of said projecting pins, bolts or stubs.

* * * * *